US005156692A

United States Patent [19]

Tsukamoto

[11] Patent Number: 5,156,692

[45] Date of Patent: Oct. 20, 1992

[54] PROCESS FOR MANUFACTURING STEEL WIRES FOR USE IN WIRE DRAWING

[75] Inventor: Takashi Tsukamoto, Osaka, Japan

[73] Assignee: Sumitomo Metal Industries, Ltd., Osaka, Japan

[21] Appl. No.: 768,635

[22] PCT Filed: Feb. 15, 1991

[86] PCT No.: PCT/JP91/00188

§ 371 Date: Oct. 9, 1991

§ 102(e) Date: Oct. 9, 1991

[87] PCT Pub. No.: WO91/12346

PCT Pub. Date: Aug. 22, 1991

[30] Foreign Application Priority Data

Feb. 15, 1990 [JP] Japan ..... 2-34525

[51] Int. Cl.[5] ..... C21D 8/00

[52] U.S. Cl. ..... 148/320; 148/598

[58] Field of Search ..... 148/598, 595, 320

[56] References Cited

U.S. PATENT DOCUMENTS 4,046,600 9/1977 Yamakoshi et al. ..... 148/598
4,604,145 8/1986 Kanabara et al. ..... 148/598
4,983,227 1/1991 Reinich et al. ..... 148/595

FOREIGN PATENT DOCUMENTS 53-30917 3/1978 Japan .
57-19168 4/1982 Japan .
64-15322 1/1989 Japan .
2-19444 1/1990 Japan .
57115 4/1970 Luxembourg .

*Primary Examiner*—Deborah Yee
*Attorney, Agent, or Firm*—Burns, Doane, Swecker & Mathis

[57] ABSTRACT

A wire of a high-carbon steel having a carbon content of 0.7%–0.9% by weight is heat-treated so as to form supercooled austenitic phases, then subjected to plastic deformation with a reduction rate of at least 20% in the temperature range of below the $Ae_1$ point and above 500° C., and transformed into pearlite without heating to the austenitic range.

The resulting pearlite has a pearlite block size of not greater than 5.0 μm. Steel filaments which have a tensile strength of at least 400 kgf/mm$^2$ and a reduction of area of at least 40% and which are suitable for use as tire cords in automobile tires can be obtained by wire drawing of the steel wire.

10 Claims, 2 Drawing Sheets

Fig. 1A
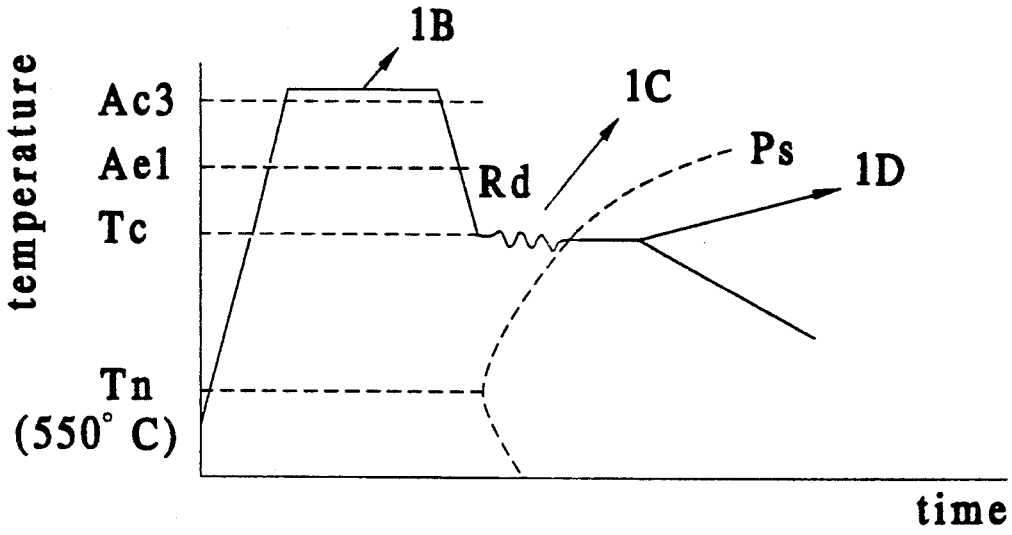
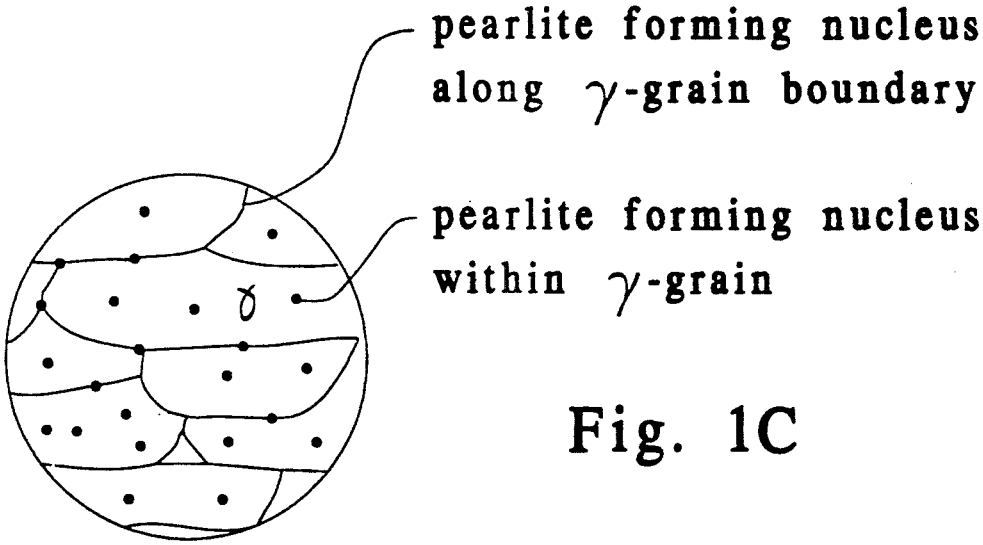
Fig. 1C
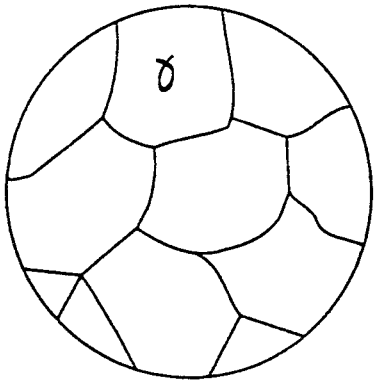
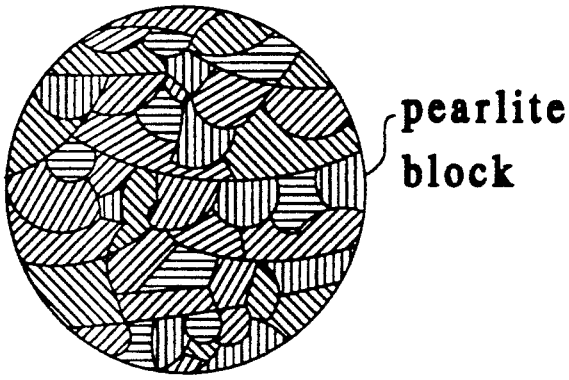
Fig. 1B Fig. 1D

PROCESS FOR MANUFACTURING STEEL WIRES FOR USE IN WIRE DRAWING

TECHNICAL FIELD

The present invention relates to a process for manufacturing steel wires for use in wire drawing, and particularly steel wires which are subsequently subjected to final wire drawing to form steel filaments which are used in the manufacture of steel cord wires.

BACKGROUND ART

Steel cord wires and bead wires which have generally been used in tires and similar products are twisted strands made by twisting a bundle of filaments of a high carbon steel, each steel filament having a diameter of around 0.2 mm. Steel filaments which are presently used for this purpose have a tensile strength on the order of 320 kgf/mm$^2$.

The conventional process for manufacturing such steel filaments comprises the following steps:

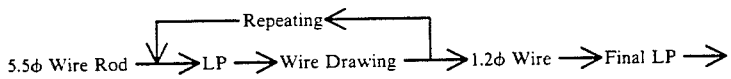

In the final lead patenting (LP) step, a 1.2$\phi$ steel wire is heated to about 900° C. and then dipped in a molten lead bath at around 600° C. to adjust the tensile strength (TS) of the wire to 125 kgf/mm$^2$. The resulting lead-patented steel wire is used as a starting material for the final drawing, and it is pickled and plated before it is finally drawn into a filament having a tensile strength of about 320 kgf/mm$^2$. In the above-described process, the wire drawing reduction ratio ($\epsilon$) attained under these conditions is around 3.2. A higher reduction ratio is desired in order to improve the strength of the wire, but it cannot be attained due to a decrease in ductility.

In co-pending Japanese Patent Application No. 63-169480 (1988), the present inventors proposed that wire drawability can be increased by performing the final lead patenting under such conditions that the resulting wire has a relatively low tensile strength (TS) of around 115 kgf/mm$^2$. However, the wire drawing reduction ratio ($\epsilon$) attainable in this method is at most $\epsilon=4.5$, and the tensile strength of the resulting filaments is on the order of 380 kgf/mm$^2$.

In the process described in Japanese Unexamined Patent Application Kokai No. 64-15322(1989), a thermo-mechanical treatment is applied in place of the final lead patenting treatment so as to refine the resulting pearlite blocks to an average size of about 6–77 $\mu$m and improve the wire drawability of the wire. This process gives steel filaments having a tensile strength on the order of 400 kgf/mm$^2$. However, after the thermo-mechanical treatment, the wire is subjected to recrystallization by heating again at a temperature in the austenitic range followed by slow cooling. Therefore, the refinement of the pearlite blocks cannot be achieved in a stable manner, and the process involves an increased number of steps, thereby requiring a prolonged processing period and leading to increased manufacturing costs. Moreover, the reduction of area of the steel filaments obtained after the final wire drawing is on the order of 30% which is rather low since the working has been applied in a high reduction ratio region. Therefore, the resulting filaments lack stability and are susceptible to breakage during twisting into cord wires.

Japanese Examined Patent Publication No. 57-19168(1982) which corresponds to Japanese Unexamined Patent Application Kokai No. 53-30917(1978) discloses a similar strengthening or toughening method of a carbon steel by a thermo-mechanical treatment. The steel material obtained in this method is a steel rod having a diameter of from 4.0 mm to 13.0 mm and it is used in the as-treated state without further wire drawing. The thermo-mechanical treatment employed in this method is performed by applying working with a reduction of area in the range of 10% to 40% to a metastable austenitic structure at a relatively low temperature (which is below 450° C. and above the Ms point) followed by isothermal heat treatment to form a structure comprising fine ferrite and cementite phases. In this case, the refinement attained by the thermo mechanical treatment is a reduction of interlaminar distance, i.e., lamellar distance, of the pearlite structure. This publication does not refer to a reduction of the pearlite block size as described above. The strength attained by the thermo-mechanical treatment is not higher than 200 kgf/mm$^2$.

It is possible to increase the strength of a starting wire which is subjected to final drawing by increasing its carbon content to 1.0% or more, for example. However, the drawability of this material is degraded by the effect of precipitated proeutectoid cementite, and therefore the resulting drawn wire cannot have an improved tensile strength.

Nowadays, tire cord wires are required to have an even higher tensile strength as the properties required for tires become more strict in order to improve the stability of automobiles during high speed driving. Accordingly, steel filaments for use in the manufacture of tire cord wires are required to have improved mechanical properties after final wire drawing such as a tensile strength (TS) of at least 400 kgf/mm$^2$ and a reduction of area of at least 40%.

In the manufacture of steel filaments, the tensile strength of the steel material is gradually increased in the course of drawing a starting wire of a high carbon steel to reduce the diameter. However, when a conventional starting steel wire having a diameter of 1–2 mm and containing a usual eutectoid structure is patented and then wire drawn, the maximum attainable tensile strength is around 320 kgf/mm$^2$ with a reduction ratio $\epsilon=3.2$, as described above.

Neither the above-mentioned technique of increasing the limiting reduction ratio $\epsilon$ by adjusting the structure so as to have relatively coarse grains before wire drawing or the technique of improving the drawability of the starting steel wire by refinement of grains (pearlite blocks) achieved by thermo-mechanical treatment as described in Japanese Unexamined Patent Application Kokai No. 64-15322(1989) can provide the desired steel filaments having a tensile strength of 400 kgf/mm$^2$ or higher and a ductility of at least 40% by subsequent wire drawing of the starting wire.

DISCLOSURE OF INVENTION

Accordingly, a first object of the present invention is to provide a process for manufacturing steel wires for use in wire drawing to manufacture steel filaments for cord wires which possess the above-described desirable properties.

A second object of the present invention is to provide steel wires for use in wire drawing from which steel filaments having a tensile strength of 400 kgf/mm$^2$ or higher and a reduction area of at least 40% and which are suitable for use in tire cord wires can be manufactured, and a process for the manufacture of such steel wires.

The present inventors conducted various investigations in order to achieve these objects and found that the drawability of a steel wire can be improved by adjusting the tensile strength before wire drawing at a target value of TS=115 kgf/mm$^2$ and applying a thermo mechanical treatment before the final wire drawing so as to form a fine pearlite structure having a pearlite block size of 5.0 μm or smaller and preferably 1.0 μm or smaller. The present inventors also investigated the conditions for thermo mechanical treatment with a view to obtaining such a fine pearlite structure by a simple process.

It was generally considered in the prior art that refinement of a pearlite structure, i.e., reduction of a pearlite block size, could be achieved only by a process comprising subjecting the worked structure to recrystallization by heating at a temperature in the austenitic range followed by slow cooling from the austenitic range temperature so as to cause a pearlite transformation. However, the present inventors have found that the pearlite block size can be sufficiently reduced by cooling from a temperature in the austenitic range to a temperature in the isothermal transformation range to cause a isothermal transformation into pearlite as long as the preceding working is performed under controlled conditions, and accomplished the present invention.

In brief, the present invention resides in a process for manufacturing a steel wire for use in wire drawing into a steel filament, comprising preparing a steel wire having a carbon content of 0.7%-0.9% by weight for final wire drawing and subjecting the steel wire to patenting treatment before the final wire drawing, wherein the patenting treatment is performed by the steps of heating at a temperature in the austenitic range above the $Ac_3$ point, rapidly cooling to a temperature in the range which is below the $Ae_1$ point and above 500° C. at such a cooling rate that does not cross the pearlite transformation starting line in the isothermal transformation diagram, applying plastic deformation in that temperature range with a reduction rate of at least 20%, and causing pearlite transformation without re-heating to the austenitic range.

In a preferred embodiment of the present invention, the plastic deformation can be applied to the wire by rolling in a rolling mill or drawing through a warm die or a roller die.

In the present description, the term "steel wire for wire drawing" means a steel wire to be subjected to final wire drawing to form a steel filament. Such wire is also referred to herein as "stock wire" or "starting wire". The term "drawn wire" means a wire obtained by the final wire drawing, i.e., a steel filament.

BRIEF DESCRIPTION OF DRAWINGS

FIG. 1 is a schematic diagram illustrating the conditions for thermo-mechanical treatment employed in the present invention in three stages and the change in metallurgical structure caused by the treatment.

BEST MODE FOR CARRYING OUT THE INVENTION

Figure 2:
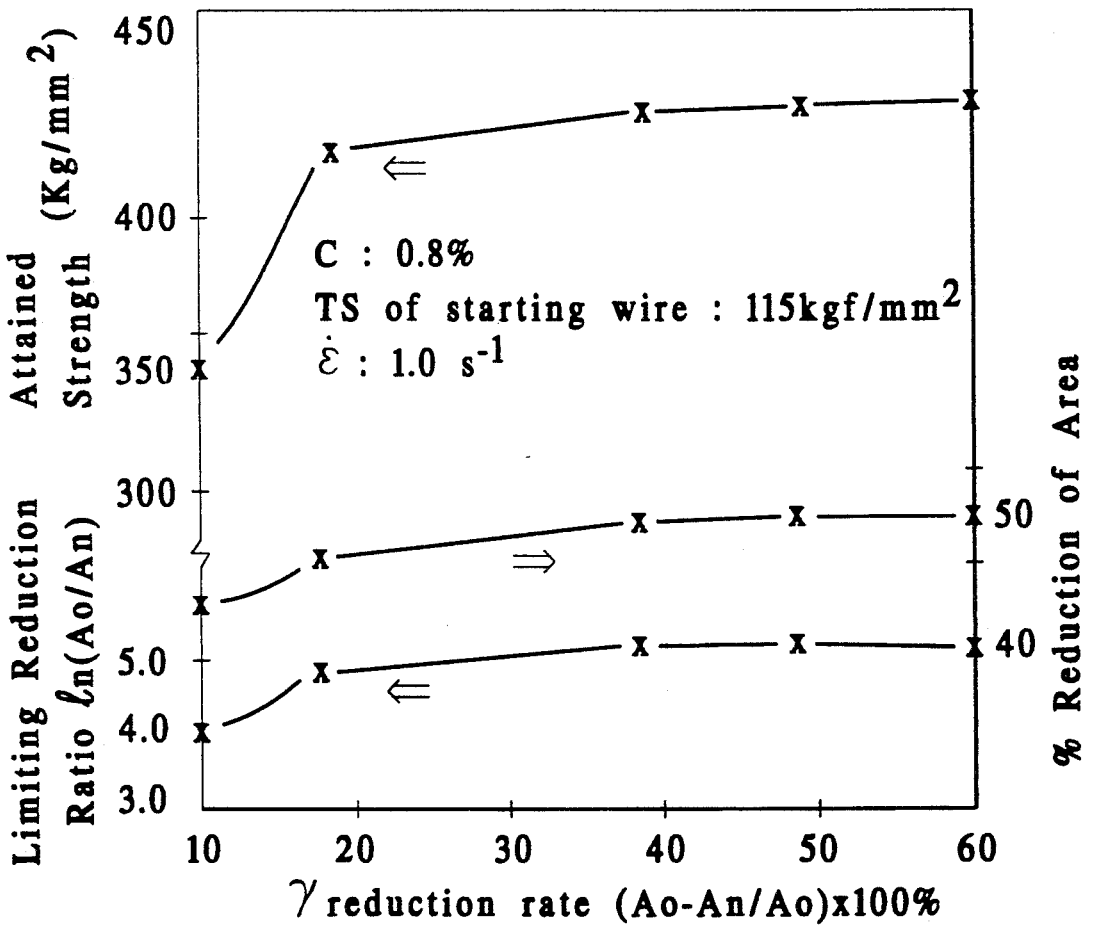
FIG. 2 is a graph showing the relationship between the reduction rate (reduction of area) in the plastic deformation applied after the rapid cooling step and the mechanical properties of the wire obtained after final wire drawing.

Referring to the accompanying drawings, the present invention will be described more fully.

FIG. 1 is a schematic diagram illustrating the conditions for thermo-mechanical treatment employed in the present invention in three stages I to III and the change in metallurgical structure caused by the treatment.

1) Stage I:

In this stage, a steel wire which is to be subjected to patenting treatment prior to final wire drawing is heated at a temperature above the $Ac_3$ point for austenitization. This heating comprises a heating step in the patenting treatment.

Thus, the heating temperature in the patenting treatment before the final wire drawing is restricted to a temperature in the austenitic range and above the $Ac_3$ point. This is because heating at a lower temperature below the austenitic range is not adequate to sufficiently eliminate internal defects formed in the preceding preliminary wire drawing steps and the resulting heated wire lacks ductility. However, if the heating temperature is too high, the grains (austenitic grains) coarsen and they cannot be refined sufficiently by the subsequent thermo-mechanical treatment. Therefore, the heating temperature is preferably in the range of from 50° C. above the $Ac_3$ point to 200° C. above the $Ac_3$ point. Usually, a temperature in the range of 850°-950° C. will fall within the above-described range of preferable heating temperature.

After heating in the austenitic range, the heated steel wire is rapidly cooled to a working temperature (Tc) which lies between the $Ae_1$ point and 500° C. at a cooling rate that does not cross the pearlite transformation starting line (indicated by the dotted line Ps in FIG. 1) in the isothermal transformation diagram.

The cooling rate in the rapid cooling to the working temperature is not restricted as long as it does not cross the pearlite transformation starting line Ps in the isothermal transformation diagram. It is important that the steel wire not undergo pearlite transformation before the completion of working and that it retain the austenitic structure formed in the heating step in the form of supercooled austenitic structure at the end of the rapid cooling step.

Generally a cooling rate of 170° C./second or higher and normally 190° C./second or higher is sufficient to prevent the steel wire from undergoing pearlite transformation. However, an extremely low cooling rate requires a prolonged cooling time, and as a result, precipitation of carbide which degrades the workability of the steel may be initiated in the supercooled austenitic structure prior to working. Therefore, a cooling rate of 200° C./second or higher is preferred.

2) Stage II:

The steel wire which has been rapidly cooled to a working temperature which is below the $Ae_1$ point and above 500° C. in the above-described manner is then subjected to plastic deformation, which is preferably performed by rolling in a rolling mill or drawing through a warm die or a roller die.

The cooling or working temperature in this stage is not critical as long as it is below the $Ae_1$ point and above 500° C. In other words, there is no limitations in that temperature as long as pearlite transformation or martensite transformation does not occur prior to working. However, cooling to a temperature lower than 500° C. decreases the wire drawability of the steel material, while working at an extremely high temperature forms a pearlite structure which is too coarse to attain a sufficient level of tensile strength. Consequently, the cooling temperature, i.e., the working temperature is preferably in the range of 600° C.±50° C. Working at a temperature outside this range may give a tensile strength which greatly deviates from the target value of 115 kgf/mm$^2$ before final wire drawing, resulting in a degradation of the drawability of the steel wire or a decrease in the tensile strength attainable after the final wire drawing.

Application of plastic deformation to a steel wire in this stage is known in the art and any known method for plastic deformation can be employed in the present invention. The plastic deformation may be performed by rolling in a rolling mill or drawing through a warm drawing die or a roller die in a conventional manner.

By applying plastic deformation to the supercooled or untransformed austenitic structure formed by the preceding rapid cooling step, the austenitic grains are wrought and pearlite-forming nuclei are introduced along the grain boundaries and within the grains. The larger the number of nuclei introduced, the finer the size of pearlite blocks formed by the subsequent isothermal transformation.

In FIG. 1, the black dots in the metallographic illustration of Stage II indicate the pearlite forming nuclei. The number of pearlite-forming nuclei introduced by plastic deformation tends to increase as the working temperature (Tc) is lowered or the reduction rate (Rd) is increased.

Therefore, in the process of the present invention, the plastic deformation is applied with a reduction rate of at least 20% and preferably at least 40%. The reduction rate ($\gamma$) is calculated based on the cross-sectional area (CSA) of a wire before and after working (drawing) as follows:

$$\text{Reduction Rate } (\gamma) = \{[(\text{CSA Before Working}) - (\text{CSA After Working})]/(\text{CSA Before Working})\} \times 100\ (\%)$$

The reason for applying plastic deformation to the supercooled austenitic structure with a reduction rate of at least 20% and preferably at least 40% is that plastic deformation with a reduction rate of less than 20% gives a filament having a tensile strength of at most around 350 kgf/mm$^2$ with a limiting reduction ratio $\epsilon$=about 4.0 during final wire drawing. Namely, by plastic deformation at a reduction rate of less than 20%, the number of pearlite forming nuclei introduced is not sufficient to cause the formation of fine grains (pearlite blocks) having a grain size of not greater than 5.0 $\mu$m during the subsequent isothermal transformation. Application of plastic deformation with a reduction rate of 40% or higher makes it possible to cause the formation of very fine pearlite blocks having a size of not greater than 1.0 $\mu$m.

FIG. 2 is a graph showing the mechanical properties of steel filaments which were prepared from a steel wire having a composition of C: 0.80%, Si: 0.45%, Mn: 0.50%, P: 0.015%, and S: 0.015% ($Ac_3$ point=745° C., $Ae_1$ point=721° C.) by heating to 900° C. for austenitization, cooling to 600° C. at a cooling rate of 20° C./second, applying plastic deformation with different reduction rates, and subjecting the wire to isothermal transformation into pearlite before it was finally drawn into a filament. It can be seen from the results shown in this figure that steel filaments having the desired properties can be obtained by plastic deformation with a reduction rate of at least 20% and preferably at least 40%.

The strain rate during the plastic deformation applied to the austenitic structure according to the present invention is not critical, but it is preferably at least 1.0 s$^{-1}$. Plastic deformation at a strain rate of at least 1.0$^{-1}$ provides further improvements in the limiting reduction ratio during final wire drawing to $\epsilon$=4.8 or higher, in the tensile strength attainable after the final wire drawing to TS=410 kgf/mm$^2$ or higher, and in the reduction of area to 45% or higher.

3) Stage III:

After the steel wire having a supercooled austenitic structure is subjected to plastic deformation, it is kept isothermally at the working temperature to cause isothermal transformation into pearlite without re-heating to the austenitic range for recrystallization. Usually, the isothermal treatment is performed by a lead patenting treatment by dipping the wire in a molten lead bath.

The treatment performed in the preceding Stage II is applied in the supercooled austenitic range. In Stage III, the steel wire is subjected to isothermal transformation to transform the supercooled austenite into pearlite. The number of pearlite blocks formed in this treatment determines the size of pearlite blocks or grains finally formed at the end of this stage. The number of pearlite blocks formed is proportional to the number of pearlite-forming nuclei introduced in Stage II, since each of the above described wrought austenitic grains is divided to form pearlite grains, the number of which depends on the number of pearlite-forming nuclei.

As shown in the metallographic illustration of FIG. 1, pearlite blocks formed in Stage III are comprised of crystal grains oriented in different directions and the average diameter of these crystal grains is the pearlite block size. In the figure, Tn indicates the nose temperature of the isothermal transformation curve.

If the plastic deformation is followed by re-heating to a temperature in the austenitic range for recrystallization and then cooled slowly, not only the number of steps is increased, but it takes a prolonged period of time to complete the slow cooling. Moreover, the re-heating treatment will cause the resulting austenitic grains to grow and grain refining cannot be attained in a sufficiently stable manner during the subsequent slow cooling step. On the other hand, if the plastic deformation is followed by rapid cooling, the formation of a bainitic structure will occur and the resulting transformed structure will be interspersed with the low-temperature transformed phases, leading to a decrease in wire drawability in the subsequent final wire drawing step. Therefore, the desired product cannot be obtained.

The tensile strength of the steel wire for wire drawing manufactured in this manner according to the present invention is preferably adjusted to TS=115 kgf/mm$^2$. If desired, the steel wire may be subjected to pickling and lubricating procedures in a conventional manner prior to final wire drawing. The final wire drawing may be performed in any conventional manner.

The chemical composition of the steel wire used in the present invention is not critical except for the carbon content.

Carbon is necessary for the steel wire in order to develop its tensile strength. The minimum carbon content is 0.7% since the desired tensile strength of at least 400 kgf/mm$^2$ cannot be attained with a lower carbon content. The maximum carbon content is 0.9% since a higher carbon content adversely affects the wire drawability of the steel wire due to the precipitation of proeutectoid cementite, resulting in a decrease in tensile strength.

If desired, the content of one or more of Si, Mn, P, and S may be restricted appropriately. An example of a suitable composition for the steel wire is C: 0.70–0.90%, Si: 0.15–1.20%, Mn: 0.30–0.90%, P: not greater than 0.01%, and S: not greater than 0.002%.

The present invention will be described more fully by the following example.

EXAMPLE

Steels having the compositions shown in Runs Nos. 1–22 in Table 1 and each weighing 150 kg were prepared by melting in a vacuum melting furnace. Each resulting ingot was hot rolled to form a wire rod having a diameter of 5.5 mm, which was then cold-drawn so as to reduce the diameter to 2.3–3.25 mm. The resulting wire was then subjected to thermo-mechanical treatment under the conditions shown in Table 1 to give a starting wire for final wire drawing.

The $Ac_3$ point of each test steel was in the range of 745°–780° C. and the $Ae_1$ point thereof was 721° C.

In the thermo-mechanical treatment performed in this example, plastic deformation in the supercooled austenitic range was applied by means of rolling in a rolling mill. It was confirmed that almost the same results were obtained by applying plastic deformation by means of drawing through a warm drawing die or a roller die.

After the final patenting treatment, the patented wire was pickled in a 20% sulfuric acid solution and then plated with brass before it was finally wire drawn by a wet continuous wire drawing machine.

The mechanical properties of the starting wires as well as the limiting reduction ratio ($\epsilon$) in the wire drawing and the mechanical properties of the drawn wires (filaments) are also shown in Table 1. The tensile strength of the starting wire was adjusted at a target of 115 kgf/mm$^2$.

The results shown in Table 1 indicate the following.

Runs Nos. 1–5 were performed in order to demonstrate the effect of the carbon content. In each of Runs Nos. 1 and 5, which are comparative examples in which the carbon content did not fall within the range defined herein, the tensile strength of the drawn wire did not reach the target value of 400 kgf/mm$^2$.

Runs Nos. 6–9 were performed in order to demonstrate the effect of the heating temperature in the thermo-mechanical treatment. In Run No. 6, which is a comparative example outside the range defined herein, the tensile strength of the drawn wire did not reach 400 kgf/mm$^2$ and the reduction of area also showed a decreased value. Runs Nos. 7–9 are all examples according to the present invention.

Runs Nos. 10–14 were performed in order to demonstrate the effect of the cooling rate. In Run No. 10, which did not fall within the range defined herein, the cooling rate was so slow that pearlite transformation occurred partially at this stage. As a result, the limiting reduction ratio showed a decreased value and the tensile strength of the drawn wire did not reach 400 kgf/mm$^2$. In the other runs, the cooling rate did not cross the pearlite transformation starting line in the isothermal transformation diagram.

Runs Nos. 15–18 were performed in order to demonstrate the effect of the working temperature on austenite. In Runs Nos. 15 and 18, which are comparative examples outside the range defined herein, the tensile strength of the resulting drawn wires did not reach 400 kg/mm$^2$.

Runs Nos. 19–22 were performed in order to demonstrate the effect of reduction rate on supercooled austenite. In Run No. 19, which is a comparative example in which the reduction ratio is 10%, which is outside the range defined herein, the tensile strength of the drawn wire did not reach 400 kgf/mm$^2$.

Moreover, the percent fracture (n=10) in a 180° bending test which indicates the deformability of drawn wires (filaments) was 0% in all the examples according to the present invention, while it was from 10% to 100% in the comparative examples.

INDUSTRIAL APPLICABILITY

As described above in detail, in accordance with the present invention, high strength and high-ductility drawn steel wires or filaments which have a diameter on the order of 0.2 mm and still possess TS (tensile strength)=410 kgf/mm$^2$ and RA (reduction of area)$\geqq$40% can be obtained, thereby making it possible to increase the tensile strength of tire cord wires and improve the performance of tires.

TABLE 1

| Run No. | Steel Composition (wt %) C | Si | Mn | Heating Temp. (°C.) | Cooling Rate (°C./sec) | γ-Working Temp. (°C.) | γ-Rd*1 (%) | Starting Wire d (mm) | TS (kg/mm²) | RA (%) | $d_s$*2 (μm) | ε*3 Limiting Reduc. | Drawn Wire (Filament) TS (kg/mm²) | RA (%) | TN | 180°*4 Bending (%) | Remarks |
|---|---|---|---|---|---|---|---|---|---|---|---|---|---|---|---|---|---|
| 1 | 0.6 | 0.45 | 0.50 | 900 | 200 | 600 | 30 | 23 | 97 | 45 | 4.0 | 4.88 | 376 | 40 | 25 | 0 | Compara. |
| 2 | 0.7 | 0.44 | 0.51 | " | " | " | " | " | 105 | 45 | 4.0 | " | 400 | 40 | 25 | 0 | Invention |
| 3 | 0.8 | 0.43 | 0.52 | " | " | " | " | " | 114 | 47 | 5.0 | " | 407 | 41 | 27 | 0 | " |
| 4 | 0.9 | 0.44 | 0.50 | " | " | " | " | " | 117 | 49 | 4.0 | " | 410 | 42 | 26 | 0 | " |
| 5 | 1.0 | 0.43 | 0.51 | " | " | " | " | " | 116 | 39 | 5.0 | 4.0 | 345 | 32 | 17 | 40 | Compara. |
| 6 | 0.8 | 0.43 | 0.52 | 720 | " | " | " | " | 120 | 25 | 8.0 | " | 350 | 30 | 15 | 10 | " |
| 7 | " | " | " | 850 | " | " | " | " | 115 | 47 | 4.0 | 4.88 | 407 | 42 | 26 | 0 | Invention |
| 8 | " | " | " | 950 | " | " | " | " | 116 | 48 | 5.0 | " | 410 | 44 | 26 | 0 | " |
| 9 | " | " | " | 1000 | " | " | " | " | 115 | 42 | 5.0 | " | 407 | 42 | 23 | 0 | " |
| 10 | " | " | " | 900 | 150 | " | " | " | 117 | 36 | 6.0 | 4.70 | 381 | 36 | 17 | 10 | Compara. |
| 11 | " | " | " | " | 170 | " | " | " | 117 | 43 | 5.0 | 4.88 | 410 | 43 | 23 | 0 | Invention |
| 12 | " | " | " | " | 190 | " | " | " | 114 | 45 | 4.0 | " | 409 | 42 | 25 | 0 | " |
| 13 | " | " | " | " | " | " | " | " | 115 | 46 | 5.0 | " | 411 | 44 | 26 | 0 | " |
| 14 | " | " | " | " | 250 | " | " | " | 115 | 47 | 4.0 | " | 410 | 45 | 28 | 0 | " |
| 15 | " | " | " | " | 200 | 800 | " | " | 102 | 36 | 10.0 | 4.40 | 364 | 36 | 17 | 10 | Compara. |
| 16 | " | " | " | " | " | 700 | " | " | 112 | 45 | 5.0 | 4.88 | 408 | 42 | 26 | 0 | Invention |
| 17 | " | " | " | " | " | 630 | " | " | 116 | 46 | 4.0 | " | 410 | 43 | 25 | 0 | " |
| 18 | " | " | " | " | 300 | 270 | " | " | 175 | 20 | — | 0.44 | 214 | 0 | 0 | 100 | Compara. |
| 19 | " | " | " | " | 200 | 600 | 10 | " | 115 | 40 | 8.0 | 4.00 | 347 | 29 | 12 | 20 | Compara. |
| 20 | " | " | " | " | " | " | 20 | " | 113 | 40 | 3.5 | 4.88 | 407 | 43 | 20 | 0 | Invention |
| 21 | " | " | " | " | " | " | 40 | " | 115 | 46 | 1.0 | " | 410 | 43 | 25 | 0 | " |
| 22 | " | " | " | " | " | " | 50 | " | 116 | 52 | 0.7 | " | 419 | 44 | 25 | 0 | " |

(Note)
*1: γ-Reduction Rate = [(Cross-sectional area before working) − (Cross-sectional area after working)]/(Cross-sectional area before working) × 100 (%)
*2: $d_s$ = Pearlite Block Size
*3: Limiting Reduction Ratio = ln[(Cross-sectional area of starting wire)/(Cross-sectional area of final drawn wire)], where the final drawn wire is the wire obtained in the drawing pass immediately before 100% breakage (fracture) by 180° bending occurs.
*4: 180° Bending: % Fracture at the bent portion by 180° tight bending.

I claim:

1. A process for manufacturing a steel wire for use in wire drawing, comprising preparing a steel wire having a carbon content of 0.7%-0.9% by weight and subjecting the steel wire to patenting treatment before final wire drawing, wherein the patenting treatment is performed by the steps of heating at a temperature in the austenitic range above the $Ac_3$ point, cooling to a temperature in the range of below the $Ae_1$ point and above 500° C. at such a cooling rate that does not cross the pearlite transformation starting line in the isothermal transformation diagram, applying plastic deformation in that temperature range with a reduction rate of at least 20%, and causing pearlite transformation without heating to the austenitic range.

2. The process for manufacturing a steel wire for wire drawing according to claim 1, wherein the plastic deformation is applied by rolling in a rolling mill or drawing through a warm die.

3. The process for manufacturing a steel wire for wire drawing according to claim 1, wherein the temperature at which the wire is heated in the austenitic range is in the range of from 50° C. above the $Ac_3$ point to 200° C. above the $Ac_3$ point.

4. The process for manufacturing a steel wire for wire drawing according to claim 1, wherein the cooling rate is 200° C./sec or higher.

5. The process for manufacturing a steel wire for wire drawing according to claim 1, wherein the plastic deformation is applied by rolling using a rolling mill, warm drawing using a drawing die, or drawing using a roller die.

6. The process for manufacturing a steel wire for wire drawing according to claim 5, wherein the temperature at which the plastic deformation is applied is in the range of 600° C.±50° C.

7. The process for manufacturing a steel wire for wire drawing according to claim 5, wherein the plastic deformation is applied with a reduction rate of 40%.

8. The process for manufacturing a steel wire for wire drawing according to claim 5, wherein the plastic deformation is applied at a strain rate of at least 1.0 $s^{-1}$.

9. A steel wire for use in wire drawing manufactured by the process according to claim 1, which has a pearlite block size of not greater than 5.0 μm.

10. A steel filament obtained by wire drawing the steel wire according to claim 9, which has a tensile strength of at least 400 $kgf/mm^2$ and a reduction of area of at least 40%.

* * * * *